US007442076B2

(12) United States Patent
Huang

(10) Patent No.: US 7,442,076 B2
(45) Date of Patent: Oct. 28, 2008

(54) POWER OUTPUT ERROR FREE APPARATUS

(75) Inventor: Yung-Hsin Huang, Taipei Hsien (TW)

(73) Assignee: Zippy Technology Corp., Hsien-Tien, Taipei Hsien (TW)

( * ) Notice: Subject to any disclaimer, the term of this patent is extended or adjusted under 35 U.S.C. 154(b) by 0 days.

(21) Appl. No.: 11/437,740

(22) Filed: May 22, 2006

(65) Prior Publication Data

US 2007/0270028 A1 Nov. 22, 2007

(51) Int. Cl.
*H01R 11/00* (2006.01)

(52) U.S. Cl. ..... 439/502; 439/188; 439/924.1

(58) Field of Classification Search ..... 439/502, 439/188, 924.1, 677; 361/683, 685; 318/139; 273/138.2
See application file for complete search history.

(56) References Cited

U.S. PATENT DOCUMENTS 3,866,920 A * 2/1975 Goldfarb et al. ..... 273/138.2
4,130,334 A * 12/1978 Anderson ..... 439/472
5,225,744 A * 7/1993 Ishikawa et al. ..... 318/139
5,330,370 A * 7/1994 Reddersen et al. ..... 439/502
5,855,064 A * 1/1999 Chang ..... 29/861
6,139,360 A * 10/2000 Hayashi et al. ..... 439/502
6,531,657 B1 * 3/2003 Jones et al. ..... 174/72 A
6,672,896 B1 * 1/2004 Li ..... 439/502
2002/0161968 A1 * 10/2002 Yoo et al. ..... 711/105
2007/0099451 A1 * 5/2007 Chou et al. ..... 439/79

FOREIGN PATENT DOCUMENTS

TW 414339 12/1989

* cited by examiner

*Primary Examiner*—Hien Vu
(74) *Attorney, Agent, or Firm*—Muncy, Geissler, Olds & Lowe PLLC

(57) ABSTRACT

A power output error free apparatus includes a power supply having a circuit board inside and a power transmission port on the surface. The circuit board has a plurality of electric connection zones electrically connected to the power transmission port. The power transmission port is connected to a connection line which has a connection port on one end corresponding and connecting to the power transmission port and a coupling end on other end connecting to a computer main board. The coupling port has a ps-on (power-supply-on) signal pin to control activation of the power supply. The power transmission port has a dummy pin or HIGH potential on a location corresponding to the ps-on signal pin. As a mistaken connection occurs by switching the connection port with the coupling port, the ps-on signal cannot be transmitted through the dummy pin or HIGH potential of the power transmission port.

4 Claims, 3 Drawing Sheets

POWER OUTPUT ERROR FREE APPARATUS

FIELD OF THE INVENTION

The present invention relates to a error free apparatus and particularly to a power output error free apparatus to protect electronic devices.

BACKGROUND OF THE INVENTION

Referring to R.O.C. patent publication No. 414339, a conventional power supply includes at least a power supply module and a control circuit. The power supply module is coupled in a parallel fashion. Each power supply module has at least one commutation circuit, a main power source, a non-stop power source and a PWRGD (power good) generation circuit. The commutation circuit has an input end to receive city power (AC) and rectify the AC power to a DC voltage, and connect to one end of the main power source and the non-stop power source. The main power source is electrically connected to the PWRGD generation circuit and has a voltage (+5V) output end. The non-stop power source is electrically connected to a switch control unit of the main power source and has a non-stop voltage (+5V) output end. The main power source switch control unit has one end electrically connected to a main board and another end connected to the main power source and the PWRGD generation circuit. When an AC power source inputs to the commutation circuit and has been rectified, the non-stop power source and the main power source connecting to the commutation circuit generate respectively a non-stop voltage and a main voltage; meanwhile the non-stop power source generates a +5V non-stop voltage to the main board. The main board connecting to the main power source switch control unit determines whether to activate the main power source of the power supply module. If it is positive, the main board transmits a Low (below 0.4V) potential ps-on (power-supply-on) signal to a control signal receiving end of the main power source switch control unit, and the main power source switch control unit transmits a control signal to activate the main power source. When the main board transmits a High potential ps-on signal, the power supply stops operation and the system stops operation.

The power supply conforming to standard EPS (encapsulation security payload) specifications now on the market has a power transmission port of 24 pins. The $16^{th}$ pin is a ps-on signal pin. The power supply conforming to ATX (advance technology extended) specifications has a power transmission port of 20 pins, and the $14^{th}$ is the ps-on signal pin. The power transmission port is coupled with a connection line which has a coupling port linking to a computer main board and a connection port on another end connecting to the power transmission port of the power supply to transmit electric power at a plurality of potentials (such as +5Vdc, +3.3Vdc, +12Vdc and the like). The ps-on High/Low signals of the main board are transmitted to the power supply through the $16^{th}$ pins of the coupling port and the power transmission port to control ON and OFF of the power supply. Take the power transmission port conforming to the standard EPS specification as an example, the voltage specification and signal pin functions are defined, from the first pin to the $24^{th}$ pin in this order; as +3.3Vdc, +3.3Vdc, GND, +5Vdc, GND, +5Vdc, GND, POK, +5Vsb, +12Vdc, +12Vdc, +3.3Vdc, +3.3Vdc, -12Vdc, GND, PS-ON, GND, GND, GND, N/C, +5Vdc, +5Vdc, +5Vdc, GND. The coupling port, from the first pin to $24^{th}$ pin, also is defined the same way. The power supply output cords now on the market all have a error free structure to prevent the connection port or coupling port from being inserted at a mistaken angle and resulting in damage of the main board or power supply. However, the conventional error free structure cannot prevent the coupling port that should be connected to the main board from being mistakenly connected to the power supply, or the connection port that should be connected to the power supply from being mistakenly connected to the main board. If the connection port and the coupling port are connected in the wrong way to the main board and power supply, when the machines are started, as the pins on the connection port and coupling port responsible for transmission of the ps-on signal are located on the same $16^{th}$ pin (or $14^{th}$ pin for the 20-pin connection port conforming to ATX specifications), the ps-on signal issued by the main board will be transmitted though the connection port and the $16^{th}$ pin (or $14^{th}$ pin) of the coupling port to the power supply, and the main power source will be set ON and cause damage of the main board. It will create serious consequence. Moreover, the power transmission port of the conventional power supply and the electric connection zone of the internal circuit board have a mating pin configuration to match the pin position of the coupling port of the main board. This makes circuit configuration of the circuit board of the power supply inflexible. Wiring of the pins on the power transmission port to the electric connection zone of equal potential on the circuit board is tortuous and more difficult. This results in a higher production cost.

SUMMARY OF THE INVENTION

Therefore the primary object of the present invention is to solve the aforesaid disadvantages. The present invention provides a power output error free apparatus to prevent mistaken coupling of the connection port and coupling port to avoid damage of electronic devices. It also greatly simplifies circuit configuration of the power supply circuit board.

To achieve the foregoing object, the power output error free apparatus of the invention includes a power supply which contains a circuit board. The circuit board has a plurality of electric connection zones of different potentials. The power supply further has a power transmission port on the surface that is electrically connected to the electric connection zones. The power transmission port is coupled with a connection line which has a connection port on one end corresponding and connecting to the power transmission port and a coupling port on another end connecting to a computer main board. The connection port and the coupling port have respectively a plurality of pins corresponding to the power transmission port to transmit the potentials. The coupling port has a ps-on (power-supply-on) signal pin to control operation of the power supply. The power transmission port also has a dummy pin or high potential on a location corresponding to the ps-on signal pin of the coupling port.

By means of the foregoing construction, in the event that the connection port and the coupling port are inserted mistakenly, the ps-on signal cannot be transmitted through the dummy pin or the high potential of the power transmission port. Hence the electronic device can be protected. Circuit configuration of the circuit board also can he greatly simplified. The pins of the same potential on the power transmission port can be arranged closely to improve flexibility without the drawback of the conventional circuit board that has to mate the pin locations of the power transmission port and the coupling port. Wiring to the electric connection zone of the same potential on the circuit board also is easier without tortuous connection.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
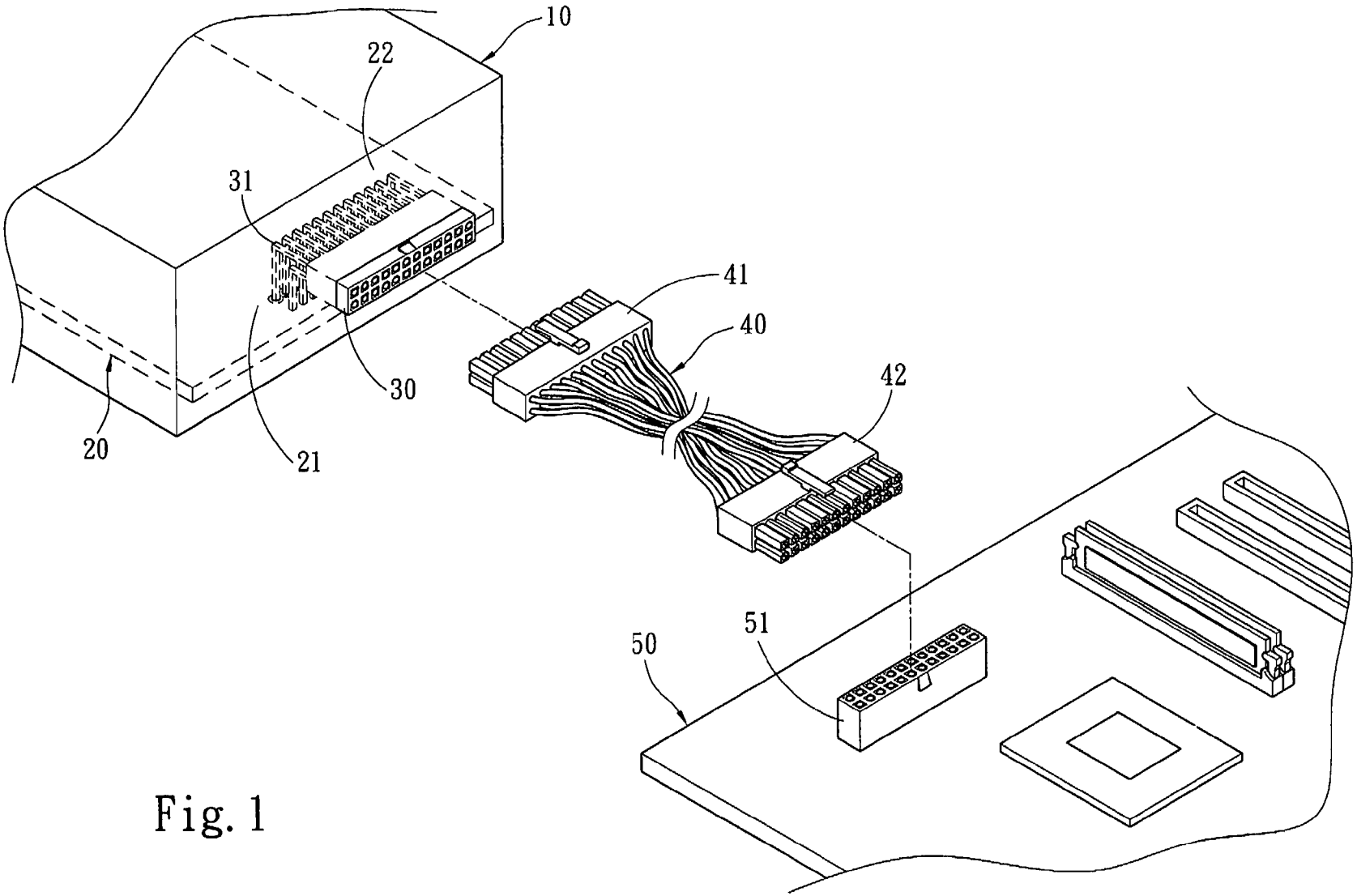
FIG. 1 is a schematic view of an embodiment of the invention.
Figure 2:
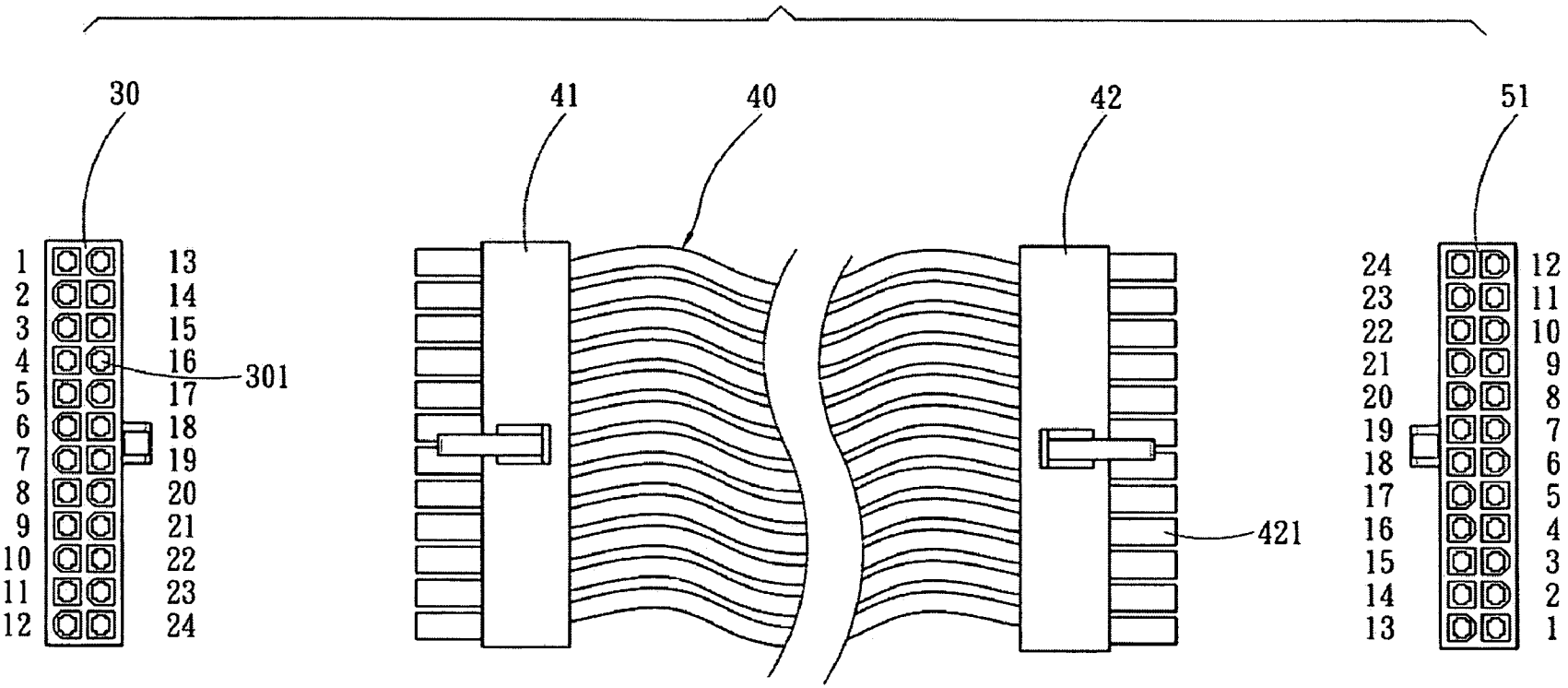
FIG. 2 is a schematic view of pin configurations of the invention.

Please refer to FIGS. 1 and 2. The power output error free apparatus of the invention includes a power supply 10 which contains a circuit board 20. The circuit board 20 has a plurality of electric connection zones 21 and 22 at varying potentials that are located in separated locations. The surface of the power supply 10 has a power transmission port 30 which includes a plurality of connection members 31 connecting to the electric connection zones 21 and 22 to equip with the varying potentials. Each of the connection members 31 has one end connecting to the pin of the power transmission port 30 and another end extended to vertically connect to the electric connection zones 21 and 22. A connection line 40 is provided that has a connection port 41 on one end corresponding and connecting to the power transmission port 30 and a coupling end 42 on other end connecting to an insertion dock 51 of a computer main board 50. Thereby electric power can be supplied to the computer main board 50. The connection port 41 and the coupling port 42 have respectively a plurality of pins corresponding to the power transmission port 30 to transmit the potentials. The corresponding pins of the connection port 41 and the coupling port 42 are jumping connected through the connection line 40 to form different potentials. The power transmission port 30, connection port 41 and coupling port 42 may have 24 pins conforming to EPS (encapsulation security payload) specifications, or 20 pins conforming to ATX (advance technology extended) specifications. The drawings illustrate 24 pins conforming to the EPS specifications. They are for illustrative purpose and not the limitation of the invention.

The power transmission port 30, from the first pin to $24^{th}$ pin in this order, is defined as +12VDC, GND, GND, GND, GND, GND, +5VDC, +5VDC, +5VDC, +3.3VDC, +3.3VDC, POK, +12VDC, GND, GND, N/C, −12VDC, GND, +5VDC, +5VDC, +5VDC, +3.3VDC, +3.3VDC, PS-ON.

The coupling port 42, from the first pin to $24^{th}$ pin in this order, is defined as +3.3VDC, +3.3VDC, GND, +5VDC, GND, +5VDC, GND, POK, +5VSB, +12VDC, +12VDC, +3.3VDC, +3.3VDC, −12VDC, GND, PS-ON, GND, GND, GND, N/C, +5VDC, +5VDC, +5VDC, GND. The $16^{th}$ pin of the coupling port 42 is used to transmit ps-on (power-supply-on) signal to activate the ps-on signal pin 421 of the power supply 10. The ps-on signal pin 421 aims to receive a ps-on signal from the computer main board 50 to control power delivery of the power supply 10. The power transmission port 30 has a dummy pin 301 (or a HIGH potential) on the location of $16^{th}$ pin corresponding to the ps-on signal pin 421 of the coupling port 42. Therefore in the event that a mistaken connection occurs that switches the coupling port 42 and the connection port 41 in the wrong way, the ps-on signal cannot be transmitted through the dummy pin 301 (or HIGH potential) of the power transmission port 30. Thus, the computer main board 50 can be protected. Circuit configuration of the circuit board 20 also can be greatly simplified. And mistaken activation of the power supply 10 due to existing of potential on the $16^{th}$ pin and erroneous connection that happen to the conventional power supply can be avoided. In the event that a connection line of 24 pins conforming to the standard EPS (encapsulation security payload) specification (or 20 pins conforming to ATX (advance technology extended) specification) is connected to the computer main board 50, the connection end coupling with the power supply 10 is defined, from the first pin to the $24^{th}$ pin in this order, as +3.3Vdc, +3.3Vdc, GND, +5Vdc, GND, +5Vdc, GND, POK, +5Vsb, +12Vdc, +12Vdc, +3.3Vdc, +3.3Vdc, −12Vdc, GND, PS-ON, GND, GND, GND, N/C, +5Vdc, +5Vdc, +5Vdc, GND (referring to the prior art previously discussed). Due to the 16th pin of the power transmission port 30 of the power supply 10 is a dummy pin or HIGH potential, the ps-on signal of the main board 50 cannot be transmitted to the power supply 10 to activate the power supply 10.

Figure 3:
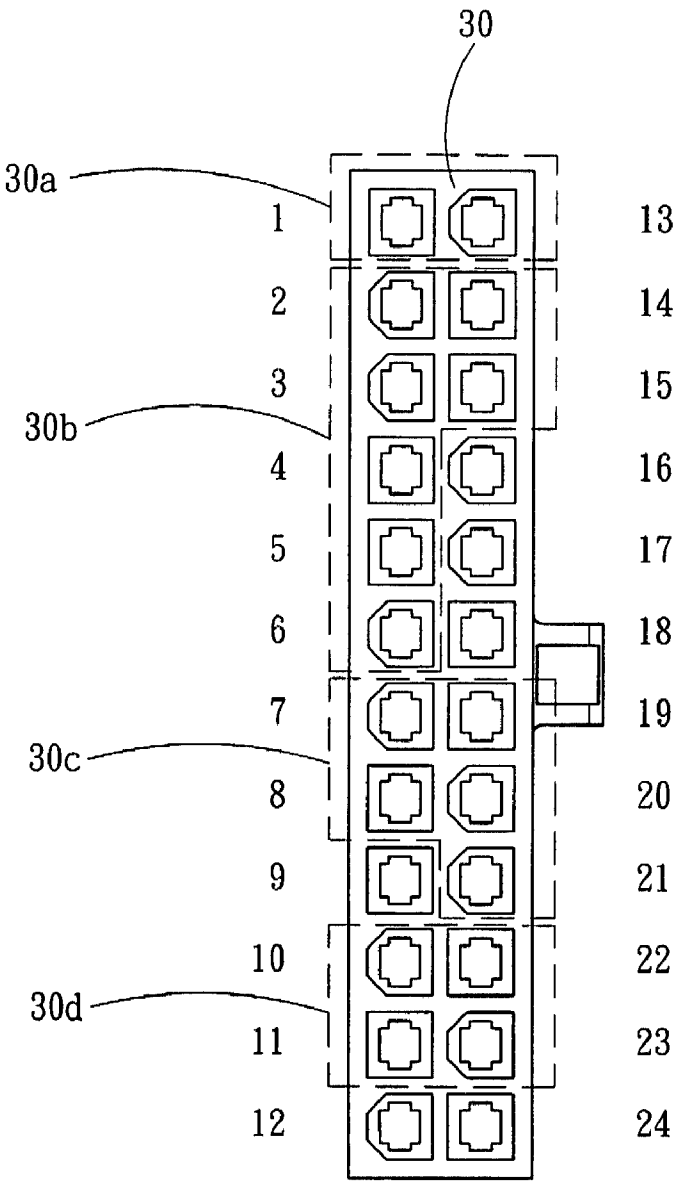
FIG. 3 is a schematic view of a potential zone configuration of the invention.

Refer to FIG. 3 for the potential zone configuration of the power transmission port corresponding to the electric connection zones of the circuit board. The pins of the same potential are located on the same potential zone of the power transmission port 30. For instance, pin numbers 1 and 13 are at the potential of +12DVC and are located on a first potential zone 30*a* of the power transmission port 30; pin numbers 2, 3, 4, 5, 6, 14 and 15 are at the potential of GND, thus are located on a second potential zone 30*b* of the power transmission port 30; pin numbers 7, 8, 19, 20 and 21 are at the potential of +5VDC, and are located on a third potential zone 30*c*; while pin numbers 10, 11, 22 and 23 are at the potential of +3.3VDC, and are located on a fourth potential zone 30*d* of the power transmission port 30.

In short, the pins of the same potential on the power transmission port 30 are preferably located on the same potential zone. Therefore the inflexible and tortuous wiring occurred to the conventional circuit board 20 that has to match the pins of the power transmission port 30 with the coupling port 42 can be prevented. Circuit configuration of the circuit board 20 of the power supply 10 can be simplified. The invention also can prevent mistaken activation of the power supply 10 caused by erroneous connection of the coupling port 42 and connection port 41. This is a novel feature and function not yet available to date.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A power output apparatus, comprising:

a power supply which has a circuit board inside and a power transmission port on the surface thereof, the circuit board having a plurality of electric connection zones of varying potentials, the power transmission port having a plurality of connection members connecting to the electric connection zones to equip with the varying potentials; and a connection line which has a connection port on one end corresponding and connecting to the power transmission port and a coupling port on other end connecting to an insertion dock of a computer main board, the connection port and the coupling port having a plurality of pins in an arrangement of pin locations corresponding to the power transmission port to transmit the potentials;

wherein the coupling port has a ps-on (power-supply-on) signal pin at a pin location corresponding to the insertion dock of the computer main board to transmit a ps-on signal to activate the power supply, and the power transmission port has a dummy pin or a HIGH potential at a pin location corresponding to the ps-on signal pin of the coupling port, so that if the connection port and coupling port are reverse connected, the ps-on signal from the computer main board will not be transmitted to the power transmission port;

wherein the corresponding pins of the connection port and the coupling port are jumping connected through the connection line to form different potentials; and wherein the power transmission port groups pins at the same potential in adjacent pin locations.

2. The power output apparatus of claim 1, wherein the power transmission port, the connection port and the coupling port have respectively 24 pins conforming to EPS (encapsulation security payload) specifications.

3. The power output apparatus of claim 1, wherein the power transmission port, the connection port and the coupling port have respectively 20 pins conforming to ATX (advance technology extended) specifications.

4. The power output apparatus of claim 1, wherein the electric connection zones of the circuit board are located separately.

* * * * *